United States Patent [19]

Pomarolli

[11] Patent Number: 4,589,572

[45] Date of Patent: May 20, 1986

[54] DISPENSING MECHANISM

[75] Inventor: Thomas Pomarolli, Farmington Hills, Mich.

[73] Assignee: New Product Development, Inc., Plymouth, Mich.

[21] Appl. No.: 506,203

[22] Filed: Jun. 20, 1983

[51] Int. Cl.[4] ..... B67B 7/46

[52] U.S. Cl. ..... 222/83.5; 222/82; 222/327; 222/521

[58] Field of Search ..... 222/325–327, 222/541, 521–525, 546, 492–493, 81–83, 83.5, 88

[56] References Cited

U.S. PATENT DOCUMENTS

| | | | |
|---|---|---|---|
| 2,561,825 | 7/1951 | Sherbondy | 222/327 |
| 4,019,654 | 4/1977 | Van Manen | 222/327 X |
| 4,253,588 | 3/1981 | Lester et al. | 222/525 X |
| 4,390,115 | 6/1983 | Bigham | 222/83 X |
| 4,438,870 | 3/1984 | Stull | 222/521 X |
| 4,461,454 | 7/1984 | Vadnais | 222/525 |

FOREIGN PATENT DOCUMENTS

| | | | |
|---|---|---|---|
| 2839284 | 3/1980 | Fed. Rep. of Germany | 222/525 |

*Primary Examiner*—Charles A. Marmor

*Attorney, Agent, or Firm*—Reising, Ethington, Barnard, Perry & Milton

[57] ABSTRACT

A dispensing assembly (10) for dispensing a highly viscous fluid from a container (12) having a sealed dispensing end (18) including a base member (24) having a first passageway (26) and a nozzle member (28) slidably mounted on the base member (24) and including a second passageway (30). A plug (32) reversibly seals off fluid flow between the passageways (26,30). A plurality of spokes (34) extend substantially radially inwardly from the base member (24) to the plug (32) defining a plurality of openings therebetween for allowing unobstructed forward flow of fluid therethrough.

7 Claims, 7 Drawing Figures

DISPENSING MECHANISM

TECHNICAL FIELD

The instant invention relates to dispensing nozzle fitments for tube applications. More particularly, the instant invention relates to nozzles for tubes of caulking compounds and other highly viscous substances.

BACKGROUND ART

Tubes for applying caulk and like substances include a variety of nozzles for dispensing the caulk and for sealing the tube between uses. Such tubes or containers generally comprise a cardboard sleeve having a metal seal at one end and a foil seal at the other. A second metal seal is disposed over the foil. Many such tubes have simple nozzle fittings at one end thereof. The foil must be broken within the nozzle to dispense the contents of the container. The U.S. Pat. No. 2,587,683 to Barry and U.S. Pat. No. 3,130,872 to Myers, et al teach nozzles having sharp annular flanges for making an annular cut about the periphery of the nozzle. The cut foil then provides an obstacle in the flow path of the viscous contents of the container. Other examples of devices for rupturing a sealed container are disclosed in the U.S. Pat. No. 1,463,443 to Selby-Fayers, et al and U.S. Pat. No. 3,401,819 to Salamone.

Once the seal of the container is broken and the contents of the container are not completely used, it is desirable to seal the container. U.S. Pat. No. 3,120,910 to Nyden teaches a resealable spout for a container including a sliding nozzle mounted on a base. A compressible plug engages that passageway of nozzle thereby sealing the passageway. Although the plug is an effective seal, the plug presents a obstacle to the forward flow path of the viscous fluid.

The instant invention provides an improvement over the prior art by providing means for rupturing the container seal so as to allow unobstructed flow through the ruptured opening. Further, the instant invention provides means for resealing the nozzle which allows for the free forward flow of fluid therethrough.

STATEMENT OF THE INVENTION

In accordance with the instant invention, there is provided a dispensing assembly for dispensing a highly viscous fluid from a container having a sealed dispensing end, the assembly including a base member including a substantially cylindrical body portion having a first passageway extending therethrough. A nozzle member is slidably mounted on the base member and has a second passageway in fluid communication with the first passageway. Valve means reverseably seal off fluid flow from the first passageway to the second passageway, the valve means including a plug for reversible sealing engagement within the second passageway. The assembly is characterized by the base member including a plurality of spokes extending substantially radially inwardly from the body portion to the plug defining a plurality of openings therebetween for allowing unobstructed forward flow of fluid therethrough. Seal rupturing means rupture the seal of the container within the circumference of the first passageway.

FIGURES IN THE DRAWINGS

A dispensing assembly constructed in accordance with the instant invention will now be described by way of example only, with reference to the accompanying drawings, in which.

DETAILED DESCRIPTION OF THE DRAWINGS

Figure 1:
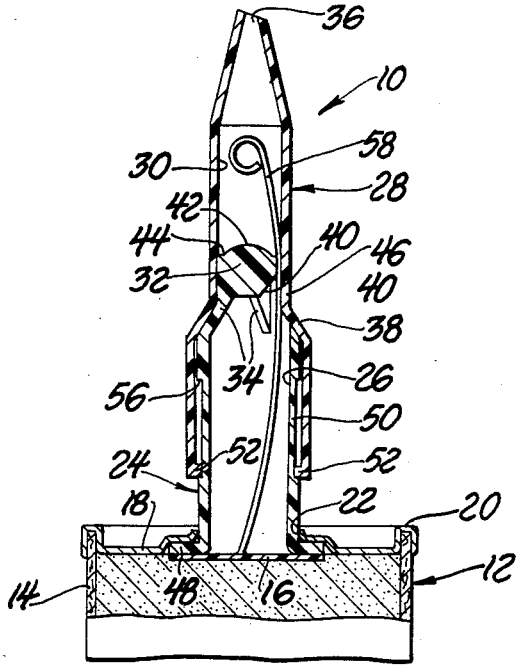
FIG. 1 is an elevational view in cross-section of the instant invention mounted on a sealed container.
Figure 2:
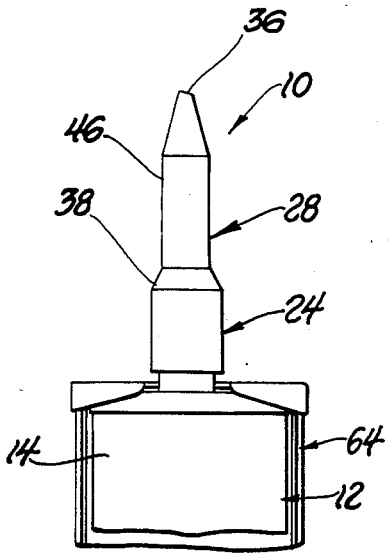
FIG. 2 is an elevational view of the instant invention.

A dispensing assembly for dispensing a highly viscous fluid constructed in accordance with the instant invention is generally shown at 10 in the FIGURES. Like numerals are used to indicate structural similarities of the several embodiments shown.

The dispensing assembly 10 is for dispensing a highly viscous fluid from a container generally indicated at 12. The container 12 includes a tubular body portion 14. A metal end plate 18 is disposed over the end portion of the tube 14 and is secured at an annular crimped portion 20. The end plate 18 has a central opening 22.

The dispensing assembly 10 includes a base member generally indicated at 24 which includes a substantially cylindrical body portion, the body portion having a first passageway 26 extending therethrough. The first passageway 26 has a predetermined circumference. A nozzle member generally indicated at 28 is slidably mounted on the base member 24 and has a second passageway 30 in fluid communication with the first passageway 26. The nozzle 28 has an opening 36 at the end thereof. The assembly 10 further includes valve means for reverseably sealing off fluid flow from the first passageway 26 to the second passageway 30, the valve means including a plug 32 for reversible sealing engagement within the second passageway 30. The assembly 10 is characterized by the base member 24 including a plurality of spaced spokes 34 extending substantially radially inwardly from the body portion of the base member 24 to the plug 32 defining a plurality of openings therebetween for allowing unobstructed forward flow of fluid therethrough. In other words, unlike prior art nozzle dispensing assemblies wherein a plug obstructs the flow of the viscous fluid as the fluid must deflect off the plug and move sideways through openings and then around the plug, the instant invention includes spokes or veins 34 which support the plug 32 on the base member 24 wherein the spokes 34 provide openings for unobstructed forward fluid flow.

Figure 3:
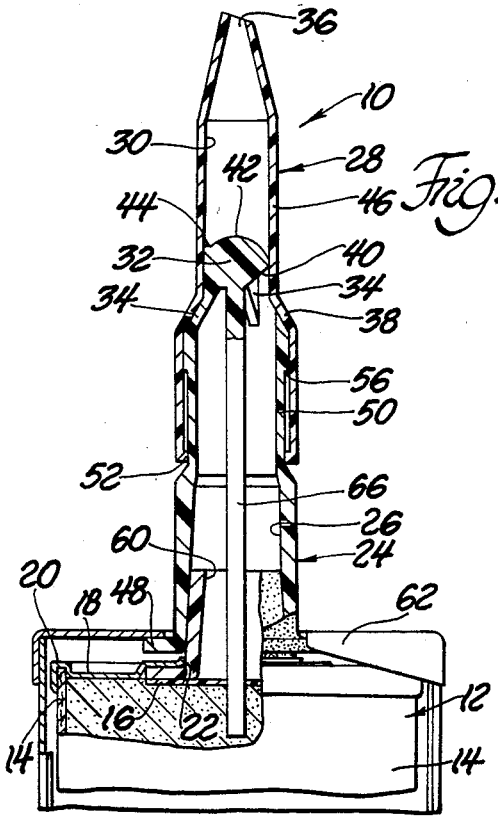
FIG. 3 is a cross-sectional view partially broken away of a second embodiment of the instant invention shown in the sealed condition.
Figure 4:
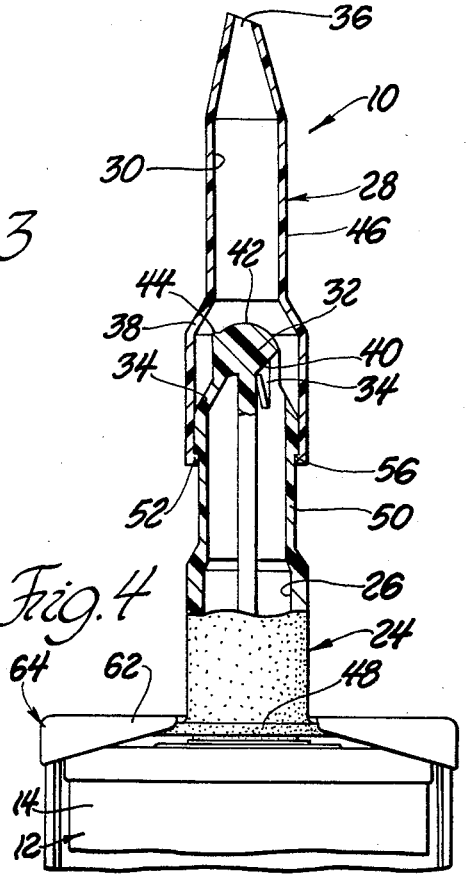
FIG. 4 is a cross-sectional view partially broken away of the second embodiment of the instant invention in an open condition.

The assembly 10 has a closed condition as shown in FIGS. 1 and 3 and an open condition as shown in FIG. 4. In the closed condition, the plug 32 engages the walls of the second passageway 30 of the nozzle member 28 so as to prevent fluid flow from the first passageway 26 through the openings defined by the spokes 34 and into the second passageway 30. In the open condition, the nozzle member 28 is moved along the base member 24 thereby removing the plug 32 from the second passageway 30 and allowing fluid flow from the first passageway 26 through the openings defined by the spokes 34 and into the second passageway 30. The fluid then flows through the opening 36 at the end of the nozzle member 28.

Each of the spokes 34 has an outer surface tapering inwardly from the body portion of the base member 24 to the plug 32. The nozzle member 28 includes a frustoconical intermediate portion 38 for reversible sealing engagement with the outer surface of the spokes 34 to perfect a seal over the openings defined by the spokes 34 while allowing unobstructed forward fluid flow through the second passageway 30 when the intermediate portion 38 is moved away from the spokes 34 as shown in FIG. 4. In other words, as shown in FIGS. 1 and 3, when the nozzle member 28 is in the closed condition, the inner wall of the intermediate portion 38 engages the spokes 34 so as to seal off the openings defined by the spokes 34. In the open condition, the slanted inner wall of intermediate portion allows for unobstructed fluid flow of the viscous fluid through the intermediate portion 38 and through the second passageway 30. Further, when in the closed condition, pressure applied to the fluid, as by a caulking gun, automatically forces the nozzle member 28 to the open condition as the forward flow of the fluid prevents a forward force against the intermediate portion 38 of the nozzle member 28. More specifically, the intermediate portion 38 provides a shoulder extending into the opening against which the fluid pressure is applied.

The plug 32 has an inner surface 40 facing the first passageway 26 and disposed above each opening defined by the spokes 34, the inner surface 40 slanting forwardly from the axial center of the inner surface to the edge thereof about the openings for allowing unobstructed fluid flow to pass through the openings. Unlike prior art assemblies wherein the plug has a flat inner surface which obstructs fluid flow so as to force the fluid to be deflected sideways past the plug, the plug 32 of the instant invention has a upwardly or forwardly slanting inner surface 40 above each opening and between each spoke 34 so as to provide an unobstructed fluid flow path.

The plug 32 has a substantially rounded forward surface 42 and a radially outwardly extending shoulder portion 44 above each of the spokes 34 for perfecting a seal against the inner wall of the second passageway 30 when the plug 32 is brought into sealing engagement therewith as shown in FIGS. 1 and 3. The shoulder 44 tightly engages the inner wall of the second passageway 30 as the rounded forward portion 42 allows for easy insertion of the plug 42 into the second passageway 30. The shoulder portion 44 may extend completely about the rounded forward surface 42 as shown in FIG. 1 or the shoulder portion 44 may be disposed above each of the spokes 34 as shown in FIGS. 3 and 4.

Preferably, the plug 32 is an inflexible solid mass, the nozzle member 30 having a flexible neck portion 46 adjacent the intermediate portion 38. The plug 32 reversibly engages the neck portion 46 to perfect a sealing mating engagement therewith. The neck portion 46 is flexible so as to allow the insertion of the plug 32 into the second passageway 30.

The base member 24 includes an outwardly radially extending flanged portion 48. The base member 24 further includes a recessed intermediate portion 50. The nozzle member 28 includes an inwardly radially extending flange 52 which sealingly engages the recessed portion 50 of the base member 24, the flange 52 slidedly engaging the recessed portion 50 so as to allow for the sliding movement of the nozzle member 28 relative to the base member 24. A shoulder portion 56 limits the forward sliding movement of the nozzle member 28 on the base member 24. Hence, three seals are perfected by the nozzle member 28. The plug 32 perfects a seal with the neck portion 46, the shoulder 44 also perfects such a seal. Finally, the flange 52 perfects a seal with the recessed intermediate portion 50.

The instant invention is further characterized by including seal rupturing means for rupturing the seal 16 of the container 12 within the circumference of the first passageway 26. In contradistinction to prior art rupturing means which ruptured the seal about the outer periphery of the passageway of the prior art nozzle, the instant invention provides means for rupturing the seal 16 of the container 12 within the circumference defined by the first passageway 26 of the base member 24. Thusly, the seal 16 ruptures within the first passageway 26 of the base member 24 and the ruptured seal does not provide an obstruction to the flow of material through the ruptured opening and into the first passageway 26.

The seal rupturing means includes an operative portion extending through the first passageway 26 beyond the flanged end portion 48 for contacting the seal 16 of the container 12 within the confines of the first passageway 26. A first embodiment of the seal rupturing means is shown in FIG. 1. In this embodiment, the flanged portion 48 is force fit into the cover 18 and a foil seal 16 is disposed over the flanged end portion 48. The base member 24 extends through the opening 22. A cord 58 provides seal connecting means for extending from the second passageway 30 through at least one of the openings defined by the spokes 34 and through the first passageway 26 to the seal 16 within the circumference of the first passageway 26. The cord 58 ruptures the seal 16 within the confines of the circumference of the first passageway 26 when the cord 58 is moved forwardly along the base member 24. In other words, prior to the initial use of the assembly 10, the nozzle 28 is in the closed condition wherein the plug 32 engages the inner wall of the second passageway 30 and the cord 58 is connected to the seal 16. As the nozzle 28 is initially moved forwardly along the base member 24, it is removed and the cord 58 is exposed. Upon pulling the cord 58 the seal 16 is ruptured within the confines of the first passageway 26. The cord 58 may then be removed by pulling the cord 58 through the opening. The cord 58 has a looped end portion 59 providing retaining means for retaining the cord 58 within the second passageway 30 and preventing the cord 58 from pulling through the opening into the first passageway 26.

A second embodiment of the seal rupturing means is generally shown at 10′ in FIGS. 3 and 4. This embodiment of the instant invention is particularly suited for a container 12 which includes an integral spout 60 overlying the seal 16 thereof. The base portion 24 is adapted to be disposed over the spout 60 and secured between the spout 60 and the forward end plate 62 of a caulking gun generally indicated at 64. The second embodiment of the seal rupturing means includes a post 66 extending from the inner surface 40 of the plug 32 through the first passageway 26 and beyond the flanged end portion 48 of the base member 24 whereby the post 66 ruptures the seal 16 within the confines of the circumference of the first passageway 26 upon insertion of the spout 60 of the container 12 into the first passageway 26 of the base member 24. The post 66 produces a rupture or opening in the seal 16 so that as the viscous fluid is forced by caulking gun 64 through the opening made in the seal 16, the opening in the seal 16 expands so as to provide an unobstructed flow path of the viscous fluid into the first passageway 26.

Figure 5:
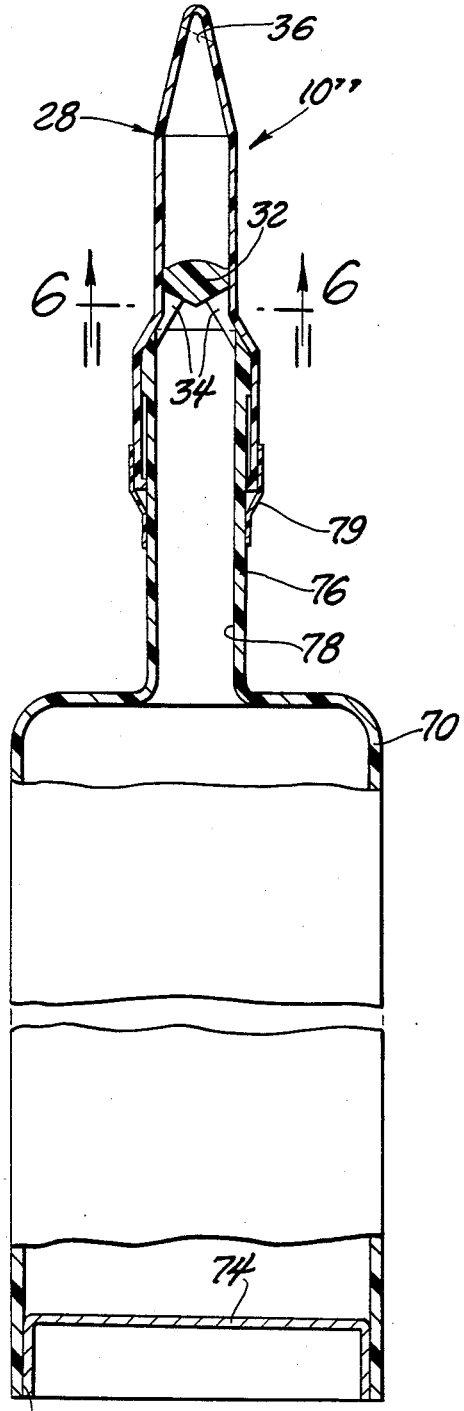
FIG. 5 is a cross-sectional view of a third embodiment of the instant invention.
Figure 6:
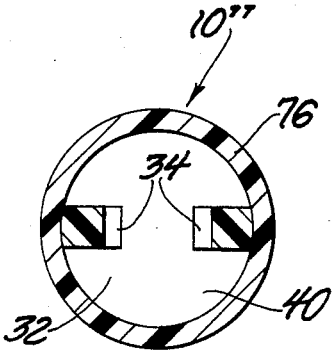
FIG. 6 is a cross-sectional view taken substantially along lines 6—6 of FIG. 5.
Figure 7:
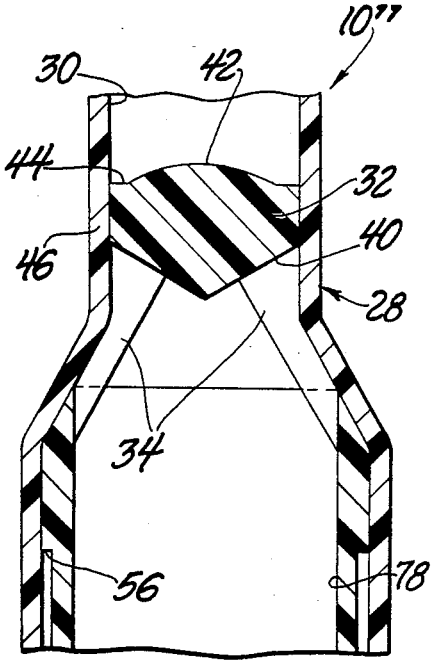
FIG. 7 is an enlarged view of the valve means of the instant invention.

A third embodiment of the instant invention is generally shown at 10" in FIG. 5. The assembly 10" includes a tubular body portion 70 having an open end portion 72. The open end portion 72 is sealed by a plug 74. The tubular body portion 70 further includes an opposite dispensing end portion including an integral spout, the integral spout including a base portion 76 extending from the dispensing end. The body of the base portion 76 is constructed similarily to the body portion of the base member 24 of the first and second embodiments of the instant invention. More specifically, the base portion 76 includes a substantially cylindrical body portion having a first passageway 78 extending therethrough. The integral spout further includes the nozzle member 28 constructed as in the first and second embodiments shown in FIGS. 1–4. Before the initial use of the container shown in FIG. 5, a seal may be perfected at the base of the base member within the tubular member 70 or externally about the nozzle member 28 as shown at 79 in FIG. 5.

A method of making the container assembly 10" includes the steps of forming the tubular member 70 having the first open end 72 and the second dispensing end having the base portion 76 extending therefrom. Specifically, the tubular member 70 may be molded from plastic to form an integral unit. The nozzle member 28 is fitted onto the base portion 76 for sliding engagement therewith. Fluid flow to the base portion 76 and nozzle 78 is then sealed off. The tubular member 70 is filled with a viscous fluid, such as caulk, by a gravity flow method and the first end 72 of the tubular member is plugged as by inserting the plug 74 into the open first end 72.

The instant invention has been described in an illustrative manner and it is to be understood that the terminology which has been used is intended to be in the nature of words of description rather than of limitation.

Obviously, many modifications and variations of the present invention are possible in light of the above teachings. It is, therefore, to be understood that in the scope of the appended claims wherein reference numerals are merely for convenience and are not to be in any way limiting, the invention may be practiced otherwise than is specifically described.

What is claimed is:

1. A dispensing assembly (10) for dispensing a highly viscous fluid from a container (12) having a sealed dispensing end (18) and an integral part (60) overlying the seal (16), said assembly (10), comprising: a base member (24) including a substantially cylindrical body portion having a first passageway (26) extending therethrough and having a predetermined circumference;

a nozzle member (28) slidably mounted on said base member (24) and having a second passageway (30) in fluid communication with said first passageway (26);

valve means for reversably sealing off fluid flow from said first passageway (26) to said second passageway (30), said valve means including a plug (32) for reversible sealing engagement within said second passageway (30) and including an inner surface, said assembly (10) characterized by said base member (24) including a plurality of spokes (34) extending substantially radially inwardly from said body portion to said plug (32) defining a plurality of openings therebetween for allowing unobstructed forward flow of fluid therethrough; and seal rupturing means for rupturing a seal (16) of the dispensing end of the container (12) within said circumference of said first passageway (26), said seal rupturing means including a post (66) extending from said inner surface of said plug (32) through said first passageway (26) and beyond said body portion whereby said post (66) ruptures the seal (16) within the confines of the first passageway (26) upon insertion of the spout (60) of the container (12) into said first passageway (26) of said base member (24).

2. An assembly as set forth in claim 1 further characterized by each of said spokes (34) having an outer surface tapering inwardly from said body portion to said plug (32), said nozzle member (28) including a frustoconical intermediate portion (38) for reversible engagement with said outer surface of said spokes (34) and defining an angled shoulder over said openings to perfect a seal over said openings when engaging said spokes (34) while allowing unobstructed forward fluid flow when said intermediate portion (38) is moved away from said spokes (34).

3. An assembly as set forth in claim 2 further characterized by said plug (32) having an inner surface (40) facing said first passageway (26), said inner surface (40) slanting forwardly from the axial center of said inner surface to the edge thereof about said openings for allowing unobstructed fluid flow thereby.

4. An assembly as set forth in claim 3 further characterized by said plug (32) having a substantially rounded forward surface (42) and a radially outwardly extending shoulder portion (44) above each of said spokes (34) for perfecting a seal against the wall of said second passageway (30) when said plug (32) is brought into sealing engagement therewith.

5. An assembly as set forth in claim 4 further characterized by said shoulder portion (44) extending completely about said rounded forward surface (42).

6. An assembly as set forth in claim 4 further characterized by said plug (32) being an inflexible solid mass, said nozzle member (30) having a flexible neck portion (46) adjacent said intermediate portion (38), said plug (32) reversibly engaging said neck portion (46) to perfect a sealing mating engagement therewith.

7. An assembly as set forth in claim 6 further characterized by said base member (24) including an outwardly radially extending flanged portion (48).

* * * * *